US006078300A

United States Patent [19]

Militz et al.

[11] Patent Number: 6,078,300

[45] Date of Patent: Jun. 20, 2000

[54] DEVICE FOR CONNECTING AN EXTERNAL ANTENNA

[75] Inventors: Uwe Militz; Wolfgang Warzecha; Bernd Lindemann, all of Berlin, Germany

[73] Assignee: Robert Bosch GmbH, Stuttgart, Germany

[21] Appl. No.: 09/107,925

[22] Filed: Jun. 30, 1998

[30] Foreign Application Priority Data

Jul. 11, 1997 [DE] Germany ..... 197 29 854

[51] Int. Cl.[7] ..... H01Q 1/50

[52] U.S. Cl. ..... 343/906; 343/713; 343/725

[58] Field of Search ..... 343/713, 725, 343/906; H01Q 1/50

[56] References Cited

U.S. PATENT DOCUMENTS

| | | | |
|---|---|---|---|
| 5,099,249 | 3/1992 | Seavey | 343/700 MS |
| 5,576,720 | 11/1996 | Gorenz, Jr. et al. | 343/702 |
| 5,610,620 | 3/1997 | Stites et al. | 343/725 |

FOREIGN PATENT DOCUMENTS

| | | | |
|---|---|---|---|
| 0 747 993 | 12/1996 | European Pat. Off. | H01Q 5/00 |
| 2 707 800 | 1/1995 | France | H01Q 1/12 |
| 91 02 092 | 5/1991 | Germany | H01Q 1/22 |
| 295 00 961 | 6/1995 | Germany | H01Q 1/32 |
| 44 33 725 | 3/1996 | Germany | H01Q 1/32 |
| 195 43 625 | 1/1997 | Germany | H01Q 1/32 |
| 195 46 010 | 6/1997 | Germany | H01Q 21/30 |

*Primary Examiner*—Don Wong
*Assistant Examiner*—Shih-Chao Chen
*Attorney, Agent, or Firm*—Kenyon & Kenyon

[57] ABSTRACT

A device for connecting an external antenna to at least one transmitting and/or receiving unit provided in a motor vehicle, the external antenna being connected via an antenna connection that has been passed through a first orifice in the vehicle body to an antenna cable linked to the at least one transmitting and/or receiving unit and being secured with anti-rotation locking to the vehicle body by a plug passed through a second orifice in the vehicle body, to render possible the connection of an additional transmitting and/or receiving device to the antenna. The plug is configured to accommodate a plug-in connection connected to the antenna. The plug-in connection is connectible to the mating connector of an antenna cable linked to at least one further transmitting and/or receiving unit.

4 Claims, 1 Drawing Sheet

DEVICE FOR CONNECTING AN EXTERNAL ANTENNA

BACKGROUND INFORMATION

It is already known to provide the antenna base of the external antenna of a motor vehicle with an antenna connection that is electrically connected to the transmitting and/or receiving part of the antenna and to pass this antenna connection through an orifice provided as a circular hole in the vehicle body, and to attach it, e.g., using threaded connection means to an antenna cable linked to a transmitting and/or receiving unit. To prevent the external antenna from twisting about the axis of the antenna connection, provision is made at the antenna base for an additional plug for locking against rotation, and this plug is passed through a second orifice of the vehicle body provided for this purpose. The two orifices are standardized in many motor vehicles and include two circular holes of different diameters, disposed at a predefined distance from one another. The drawback in this context is that only one antenna connection is able to be passed through the first orifice. If it is required to connect a second transmitting and/or receiving unit via a separate antenna cable to the antenna, then a third orifice must be made available for leading through an additional antenna connection. This is not possible using the standard connections of most automotive manufacturers.

SUMMARY OF THE INVENTION

The control unit according to the present invention has the advantage that the external antenna is able to be connected via an additional plug-in connection to a second transmitting and/or receiving unit, without having to alter the standard orifices provided for this in the vehicle body. This is advantageously achieved in that the plug introduced into the second orifice is provided (configured) to accommodate an additional antenna connection configured as a plug-in connection. Integrating a second antenna connection in the plug makes it possible to connect a further transmitting and/or receiving unit to the antenna (duplex system), without having to alter the standard orifices in the vehicle body specified by the automotive manufacturer.

It is beneficial to design the plug-in connection integrated in the plug as a coaxial cable connection that meets SMB standards. The benefit attained hereby is that, for example, a radio can be linked to the antenna connection that has been passed through the first orifice in the vehicle body and, moreover, a transmitting and/or receiving unit for GPS signals (e.g., a satellite telephone) can be connected to the antenna. This is not possible using known devices for connecting an antenna.

DETAILED DESCRIPTION

Figure 1:
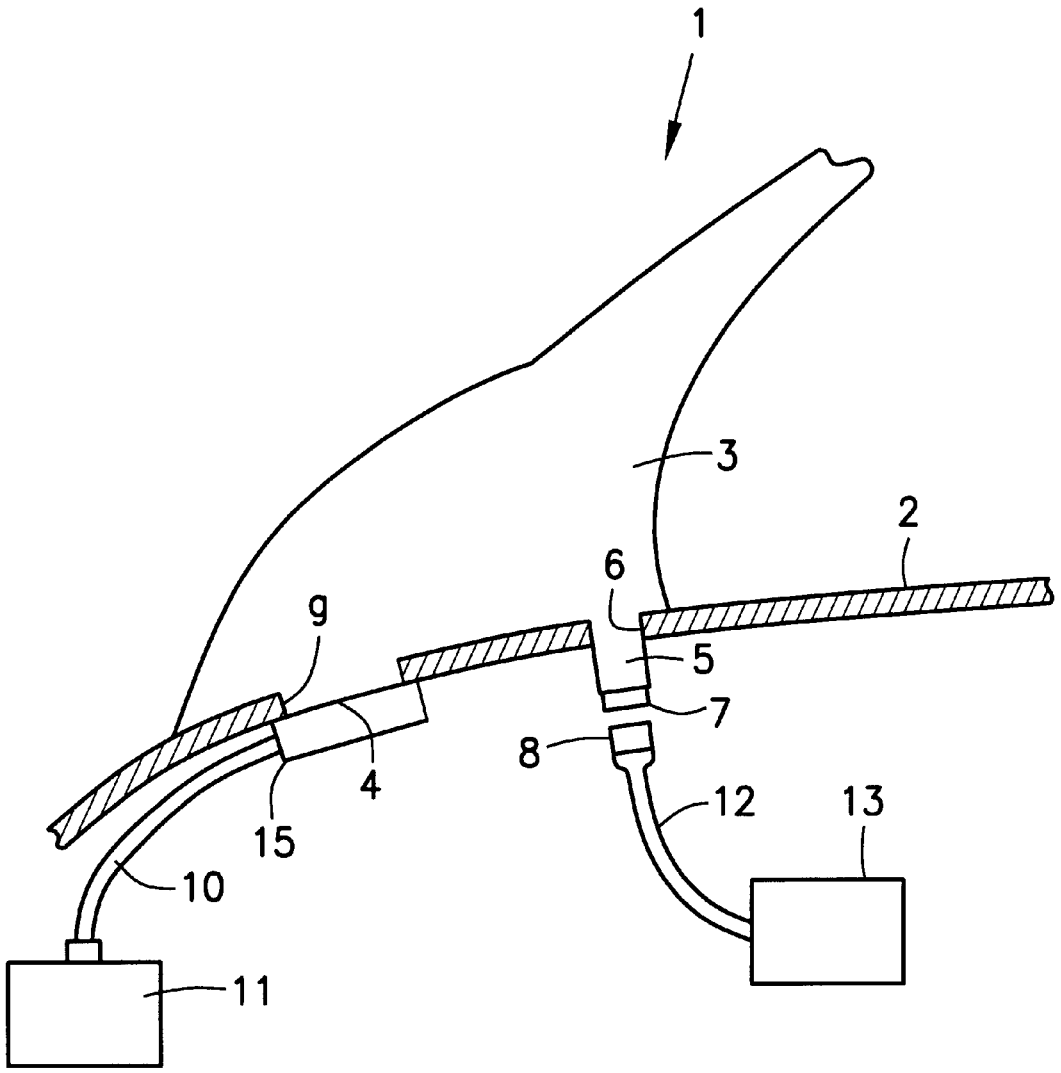
FIG. 1 depicts schematically a cross-section through an external antenna mounted on a vehicle roof.

As revealed in FIG. 1, a body part 2 of a motor vehicle his a first orifice 9 and a second orifice 6 for securing an external antenna 1. The orifices are formed as circular holes having a standard diameter specified by the automotive manufacturer. Antenna 1 has an antenna base 3, mounted upon motor vehicle body 2, including an antenna connection 4, which is guided through first orifice 9 to the vehicle interior, and is secured there by a fixing means 15 to vehicle body 2. Moreover, an antenna cable 10 linked to at least one first transmitting and/or receiving unit 11, which, for example, can be a radio or a GSM telephone, is attached via fixing means 15 to antenna connection 4.

Without plug 5, antenna 1 would not be secured with anti-rotation locking to body 2. For that reason, FIG. 1 also reveals that a plug 5 joined to antenna base 2 is guided through a second orifice 6 in body 2. This plug 5 is used, on the one hand, as anti-rotation protection and, on the other hand, for accommodating an additional antenna connection constituted as plug-in connection 7, which is connected to the transmitting and receiving part of antenna 1. In addition, plug-in connection 7, which is set (flush-mounted) in the plug, is able to be connected to mating connector 8 of an antenna cable 12, which is connected to a second transmitting and/or receiving unit 13. Preferably, plug-in connection 7 is a 50-ohm coaxial cable connection or an SMB plug connector, which is suitable, for example, for GPS (global positioning system) signals. Unit 13 can be a satellite telephone, for example. By way of plug-in connection 7, it is possible to transmit transmission signals on antenna 1 and, at the same time, to receive radio signals from a satellite. By way of antenna connection 4, one can then simultaneously receive radio or use a GSM telephone, for example.

What is claimed is:

1. A device for connecting an external antenna to a first communication unit and to a second communication unit in a motor vehicle, each of the first and second communication units including a transmitting and/or receiving unit, the device comprising:

an antenna connection passing through a first orifice in a body of the vehicle for connecting the external antenna to a first antenna cable coupled to the first communication unit;

an anti-rotation locking plug passing through a second orifice in the vehicle body, the anti-rotation locking plug preventing a rotation of the external antenna with respect to the vehicle body; and a plug-in connection for connection to a mating connector of a second antenna cable coupled to the second communication unit, the plug accommodating the plug-in connection to connect the external antenna to the plug-in connection.

2. The device according to claim 1, wherein the plug-in connection is configured as a coaxial cable connection.

3. The device according to claim 1, wherein the plug-in connection is configured as an SMB plug connector.

4. The device according to claim 1, wherein the second communication unit transmits and receives GPS signals.

* * * * *